United States Patent [19]

Coone et al.

[11] Patent Number: 5,027,894

[45] Date of Patent: Jul. 2, 1991

[54] THROUGH THE TUBING BRIDGE PLUG

[75] Inventors: Malcolm G. Coone, Katy; Jeffry C. Ehlinger, Sugerland, both of Tex.

[73] Assignee: Davis-Lynch, Inc., Pearland, Tex.

[21] Appl. No.: 517,304

[22] Filed: May 1, 1990

[51] Int. Cl.[5] ..... E21B 33/127; E21B 33/129

[52] U.S. Cl. ..... 166/122; 166/187

[58] Field of Search ..... 166/122, 134, 187, 120; 277/34

[56] References Cited

U.S. PATENT DOCUMENTS

| | | | |
|---|---|---|---|
| 2,738,013 | 3/1956 | Lynes | 166/187 X |
| 2,738,016 | 3/1956 | Lynes | 166/187 X |
| 2,738,017 | 3/1956 | Lynes | 166/187 X |
| 2,738,018 | 3/1956 | Lynes | 166/187 X |
| 3,524,503 | 8/1970 | Baker | 166/187 X |
| 4,892,144 | 1/1990 | Coone | 166/122 |

OTHER PUBLICATIONS

Schlumberger Brochure entitled "PosiSet Plug".

Page of Baker Advertising entitled, "Thru-Tubing Inflatable Plug-Back Systems".

Page of Baker Advertising Entitled, "Work is Over Live with Baker Service Tools".

*Primary Examiner*—Stephen J. Novosad

*Attorney, Agent, or Firm*—Vaden, Eickenroht Thompson & Boulware

[57] ABSTRACT

There is disclosed a through the tubing bridge plug adapted to close off a well bore beneath the lower end of a well tubing and which includes a tubular body connectable to a pipe string for lowering it through the well tubing, an elastomeric packing element surrounding the body, and upper and lower sets of thin, elongate metal strips surrounding the body respectively above and below the packing element. The upper strips are caused to move downwardly and the lower strips to move upwardly to cause their ends to slide over expander surfaces and outwardly against the well bore, on the body above and below the packing element, and the packing element is then inflated into engagement with the well bore intermediate the ends of the strip ends of the metal strips being forced outwardly against the well bore, and the packing element then being inflated to sealably engage the well bore intermediate the ends of the upper and lower metal strips.

7 Claims, 1 Drawing Sheet

THROUGH THE TUBING BRIDGE PLUG

This invention relates generally to bridge plugs for closing off a well bore; and, more particularly, to improvements in a bridge plug having a sleeve or packing element of elastomeric material which is adapted to be lowered through a well tubing and then expanded into engagement with the well bore in which the tubing is disposed.

Plugs or packers of this type are useful, for example, in closing off a well bore above a lower zone or formation which has become non-productive, whereby oil or gas may be produced from a zone or formation above the plug without the necessity of pulling the tubing or killing the well. Such plugs may be lowered through the tubing on a wireline and then set by axially compressing the packing element to expand it against the well string. In other cases, the plug may be so lowered by means of a thin well pipe such as coiled tubing about which the packing element is disposed, whereby the packing element may then be inflated to expand it against the well bore by fluid pressure supplied thereto from the surface. In any case, following the setting of the plug, the wireline or well string may be released from the plug and retrieved through the tubing. Due at least in part to the substantial extent to which the elastomeric packing element must be expanded, it is necessary to back it up, both above and below, by metal reinforcements of some kind.

U.S. Pat. No. 4,892,144, assigned to the assignee of the present application, shows a packer having an inflatable packing element which is reinforced by thin, elongate strips which surround the packing element and whose side edges are so arranged as to overlap when the packer is set. The outer sides of at least a portion of the strips are covered with an elastomeric material, so as to seal with respect to the well bore, while the outer sides of at least certain of the uncovered strips are provided with means for gripping the well bore, as the packing element is expanded, so as to resist vertical movement of the packer from its set position.

The substantial extent to which the inflatable packing element must be expanded also requires that it be thick enough to stretch the necessary amount without bursting, and this would in turn require a thick layer of metal reinforcing strips to reinforce and back up the packing element, and a plug having a packing element sufficiently thick to prevent burting, and surrounded by metal strips and an outer cover of elastomeric material, as in the packer of the aforementioned patent, could not be lowered through the tubing. It is therefore an object of this invention to provide a through the tubing plug having many if not all of the advantages of the packer of the prior patent, but nevertheless having a relatively thick packing element and layer of reinforcing strips so arranged with respect to one another as to permit it to be lowered through the tubing; and, more particularly, to provide such a plug whose packing element, when inflated, is reinforced both above and below by metal strips whose outer diameter, prior to expansion and while lowered through the tubing, is no greater than that of the inflatable element.

These and other objects are accomplished, in accordance with an illustrated and preferred embodiment of the invention, by a plug of the type described having a body connectable to a pipe string for lowering therewith through the well tubing, an elastomeric packing element surrounding the body, a first set of relatively thin, elongate metal strips surrounding the body above an upper, downwardly diverging expander surface about the body above the packing element, and a second set of relatively thin, elongate metal strips surrounding the body below a lower upwardly diverging expander surface about the body below the packing element. A means including piston means is provided for moving the first set of strips downwardly to cause their lower ends to slide over the upper expander surface and outwardly against the well bore, and for moving the upper ends of the second set of strips upwardly over the lower expander surface and outwardly against the well bore, and fluid pressure is initially supplied to the piston means for so moving the upper and lower sets of strips and then to the inside of the packing element so as to expand it into engagement with the well bore intermediate the ends of the first and second sets of reinforcing strips. In the illustrated embodiment of the invention, the piston means includes upper piston means for so moving the upper strips and lower piston means for so moving the lower strips.

Thus, as will be more fully understood from the description to follow, the outer diameter of the plug, as it is lowered through the tubing, need be no greater than that of the packing element. More particularly, the strips of each set are so arranged that the sides of their ends overlap when expanded, and at least certain of the strips have means on their outer sides for gripping the well bore when engaged therewith, whereby the strips are effective to reinforce the packing elements to resist pressure differentials across it in much the same manner as in the packer of the aforementioned patent.

The fluid supplying means comprises first conduit means in the body connecting with the first and second piston means, and second conduit means in the body connecting with the inside of the inflatable element. The upper end of the body is connectable to the pipe string to enable pressure fluid to be supplied through the pipe string to each conduit means from a common source, and the second conduit means has normally closed valve means therein adapted to open when the ends of the strips have been expanded against the well bore. More particularly, the ends of the strips and the packing element are held against the well bore despite a reduction in the fluid pressure.

Preferably, the body is tubular and has a bore therein whose upper end is connectable to the well string and whose lower end is closed so as to contain fluid pressure supplied thereto through the well string, as well as a port therein connecting its bore within the inside of the packing element and additional ports therein connecting its bore with pressure chambers in the body in which the first and second pistons are slidable. More particularly, a tube extends with the bore of the body in spaced relation thereto and has a closed lower end and upper and lower heads thereabout closing the bore, the upper and lower heads having longitudinal ports therethrough to permit fluid pressure to pass downwardly through the upper head and between the tube and bore and through the tube beneath the lower plug to connect with the additional ports connecting with the pressure chambers, and the lower head having ports therein connecting the lower end of the tube with the port connecting with the inside of the packing element. More particularly, valve means is provided in the upper end of the tube for normally closing it so that pressure fluid supplied through the pipe string is confined to flow first through the ports in the head in order to expand the ends of the upper and lower strips, but adapted to open in response to increased fluid pressure in order to inflate the packing element. As illustrated, each of the first and second piston means are initially connected to the body in their positions holding the strips contracted, thereby prevented their inadvertent movement to expand the strips but then released therefrom in response to the supply of fluid to the piston mean in order to expand the ends of the strips.

The valve means includes means for returning it to closed position upon reduction in the fluid pressure, and the body and each of the first and second piston means have means for automatically locking each piston means in the position to which it has been moved to expand the ends of the strips, whereby the bridge plug remains set despite reduction in the fluid pressure in the well string.

In the drawings, wherein like reference characters are used throughout to designate like parts:

Figures 1, 2, 3:
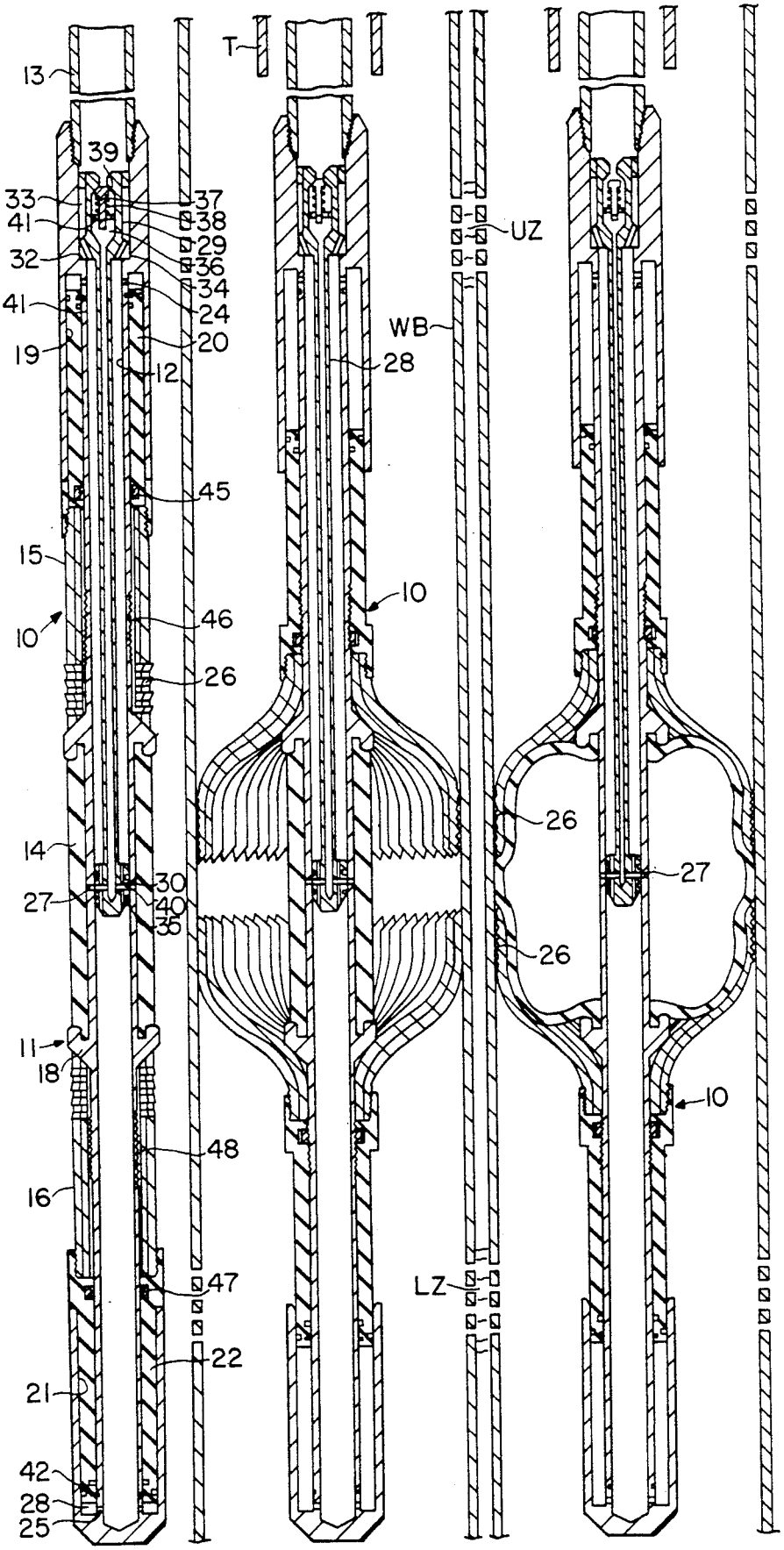
FIG. 1 is a vertical sectional view of a bridge plug constructed in accordance with a preferred embodiment of the present invention.
FIG. 2 is another vertical sectional view of the bridge plug upon lowering through a tubing and expansion of its metal strips into engagement with the well bore beneath the tubing.
FIG. 3 is a view similar to FIG. 2, but upon expansion of the packing element into engagement with the well bore intermediate the ends of the upper and lower sets of metal strips.

With reference now to the details of the above described drawings, the overall bridge plug, which is indicated in its entirety by reference character 10, is shown to comprise a tubular body 11 having a bore 12 therethrough connectable at its upper end to the lower end of a pipe string 13, a packing element 14 of rubber or other elastomeric material surrounding a mid portion of the body, and upper and lower sets 15 and 16, respectively, of thin, elongate, metal strips disposed about the body above and below the packing element. When the packing element and strips are in their relaxed, contracted positions, as shown in FIG. 1, the bridge plug 10 may be lowered on the pipe string downwardly through the lower end of a tubing T for disposal opposite a well bore WB, which, as shown in FIGS. 2 and 3, may comprise a casing string.

When the plug has been so lowered, the lower ends of the upper and lower sets of metal strips may be expanded outwardly against the well bore, as shown in FIG. 2, and the packing element may then be expanded outwardly to conform at its upper and lower ends to the inner sides of the expanded lower ends of the strips and to expand outwardly into engagement with the well bore intermediate the ends of the upper and lower sets of strips as shown in FIG. 3. More particularly, and as shown in FIGS. 2 and 3, the bridge plug has been lowered into a position in which the packing element has been expanded into engagement with the well bore above perforations connecting with a lower zone LZ and beneath perforations connecting with an upper zone in the well. Thus, as previously noted, in a typical use of the tool, wherein the lower zone will have been depleted or non-functioning and production is desired from the upper zone, the set bridge plug forms a fluid barrier between the two zones to permit the upper zone to be produced through the tubing T without pulling same or killing the well. As previously described, the tubular body also has an upper, downwardly diverging expander surface 17 intermediate the upper end of the packing element 14 and the lower ends of the upper set of metal strips 15, and a lower expander surface 18 which diverges upwardly intermediate the lower end of the packing element 14 and the upper ends of the metal strips 16. The body also has an upper annular space 19 to receive an upper annular piston 20 connected at its lower end to the upper ends of the upper set of metal strips 15, and a lower annular space 21 which receives a lower annular piston 22 having its upper end connected to the lower ends of the metal strips 16. Thus, upon lowering of the upper piston and raising of the lower piston, the lower ends of the upper strips and upper ends of the lower strips 16 are caused to slide over the upper and lower expander surfaces 17 and 18, respectively, and outwardly against the well bore, as shown in FIG. 2.

The upper piston 20 is so moved in response to the supply of pressure fluid to a pressure chamber 22 formed between the upper end of the piston and the upper end of the space 19, while the lower piston 22 is caused to move upwardly in response to the supply of pressure fluid to the annular chamber 23 formed between the lower end of the piston and the lower end of the annular space 21. As will be described in more detail to follow, fluid pressure is supplied to these chambers through ports 24 connecting the upper end of the bore 12 of the tubular body with the chamber 22, and ports 25 connecting the lower end of the bore with the annular chamber 23. As shown, seal rings are carried about the inner and outer diameters of the pistons for sealably engaging the inner and outer walls of the annular spaces in the tubular body during reciprocation therein.

As previously described, the metal strips of the upper and lower sets are so arranged that the sides of their ends will remain in overlapping relation when expanded outwardly against the well bore, as shown in FIG. 2. Obviously, therefore, it is necessary to so mount the ends of the strips on the ends of the pistons that their upper edges overlap to a sufficiently large extent with respect to one another when contracted as in FIG. 1 as to accommodate for movement of the outer edges of adjacent strips circumferentially away from one another as they are expanded to the position of FIG. 2. For this purpose, the upper ends of the upper set of strips 15 and lower ends of strips 16 are mounted on the lower ends of the pistons in a manner shown and described in the aforementioned U.S. Pat. No. 4,892,144.

As shown in the drawings, the lower edges of the lower ends of the upper set of strips and the upper edges of the upper ends of the lower sets of strips are tapered to conform with the taper of the expander surfaces at their upper and lower ends, thus facilitating sliding of the end edges along the expander surfaces. This configuration of the end edges of the strips arranges them in a substantially conical pattern, which they assume by virtue of the manner in which they are mounted on the ends of the pistons, as will be appreciated from a study of the aforementioned patent.

When the ends of the upper and lower sets of strips have been expanded into engagement with the well bore, they are spaced from one another generally opposite the central portion of the packing element 14. This then provides a window or space through which the central portion of the packing element may be expanded outwardly into sealing engagement with the well bore, as shown in FIG. 3. In the process of being so expanded by the supply of fluid pressure to the inside of the packing element through ports 27 in the body, the upper and lower portions of the packing element above and below the central sealing portion are caused to expand into engagement with the inner sides of the expanded upper and lower sets of metal strips. In this way, the metal strips provide a backup for the packing element and the lower ends of the upper strips and the upper ends of the lower strips are forced more tightly into engagement with the well bore. More particularly, and as previously described, at least certain of the lower ends of the upper strips and upper ends of the lower strips are provided with tabs 26 which extend outwardly therefrom for biting into the well bore, whether cased or otherwise. Preferably, these tabs are formed by punching out portions in the ends of certain of the metal strips, as more particularly described in the aforementioned U.S. patent.

The bridge plug also includes a tube 28 which extends longitudinally within the bore of the tubular body in spaced relationship thereto to provide an annulus between the tube and bore. The tube has a head 29 about its upper end and a head 30 about its lower end generally opposite the ports 27 in the body and the mid portion of the packing element 14. The tube is supported in this position within the tubular body by means of a shoulder on its lower end supported on a seat 32 in the upper end of the bore through the tubular body. The tube may be assembled within the tubular body by lowering through the open end of the bore prior to its connection to the well string.

The outer diameter of the upper end of the head 29 is reduced to provide an annular passageway 33 which connects at its lower end with longitudinal ports 34 in the head so as to connect the upper end of the bore of the tubular body and the pipe string 13 with the annulus. The lower plug has seal rings thereabout which engage the bore of the body for closing off the lower end of the annulus above and below ports 27 and longitudinal passageways 35 therethrough for connecting the annulus above the lower head with the bore of the tubular body beneath it. Thus, as will be understood, pressure fluid supplied to the bore of the tubular body through the pipe string 13 will flow into the pressure chambers 22 and 23 so as to urge the upper piston downwardly and the lower piston upwardly.

The upper head also has a bore 36 therethrough connecting the bore of the tubular body above the head with the interior of the tube leading to its lower end. A check valve member 37 is releasably connected to the head by a shear pin to hold its upper end against a downwardly facing seat 39 at the upper end of the bore 36 to normally close the upper end of the interior of the tube. In this way, the supply of pressure fluid at a first level is initially confined for flow into the upper and lower fluid pressure chambers for the purpose of moving the lower ends of the upper strips and the upper ends of the lower strips outwardly into engagement with the well bore, as shown in FIG. 2.

The operator at the surface level will of course note an increase in the fluid pressure indicative of the fact that the ends of the strips have been moved into engagement with the well bore so as to resist further movement of the pistons. At this time, increased fluid pressure is effective to shear the pin and thus move the check valve member downwardly to its open position, thereby permitting the passage of fluid pressure into the tube, as shown in FIG. 3. Lateral ports 40 in the lower head connect the lower end of the tube with the outer side of the head vertically intermediate the seal rings thereabout so that the increased fluid pressure in the tube is confined to flow outwardly through the ports 27 leading to the inner side of the packer element 14. This increased pressure is thus effective to inflate the packing element and thus cause its upper and lower ends to move outwardly into conformity with the inner sides of the expanded ends of the metal strips and its central portion to move outwardly between the spaced apart ends of the upper and lower strips so as to sealably engage the well bore, as shown in FIG. 3.

The upper piston is initially held in its upper position, as shown in FIG. 1, by means of one or more shear pins 41 connecting it to the tubular member, and the lower piston is initially held in its lower position by means of one or more shear pins 42 connecting it to the tubular body. This of course will maintain the metal strips contracted as the plug is lowered through the tubing and into the casing. However, upon the supply of pressure fluid through the pipe string to the pressure chambers, the pins are sheared to cause the upper piston to move downwardly and the lower piston to move upwardly. As the upper metal strips are moved downwardly with the piston, teeth on the inner side of a split ring 45 carried on the inner diameter of the piston will slide over and engage with rachet teeth 46 formed on the outer diameter of the tubular body located above the expander surface 17 in order to lock the upper piston and thus the upper set of metal strips in their expanded positions. In like manner, a split ring 47 is carried within the inner diameter of the lower piston for sliding over and engaging rachet teeth 48 formed on the outer side of the tubular body beneath the expander surface lB so as to lock the lower piston and thus the upper set of strips in their expanded position.

As shown, the lower end of the check valve member is disposed within a vertical guide mounted within the bore through the head, and is yieldably urged to its closed position by means of a coil spring 38 acting between the guide and the enlarged head on the upper end of the check valve member. Thus, upon reduction in the fluid pressure within the pipe string, following setting of the bridge plug in the position of FIG. 3, the valve is closed to contain fluid pressure on the inside of the packing element so as to maintain it along with the ends of the strips in expanded positions, and thus maintain the bridge plug in its set position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

WHAT IS CLAIMED Is:

1. A through the tubing bridge plug adapted to close off a well bore beneath the lower end of a well tubing, comprising a body connectable to a pipe string for lowering therewith through the well tubing, an inflatable elastomeric packing element surrounding the body, said body having downwardly and upwardly diverging expanding surfaces respectively above and below the packing element, a first set of relatively thin, elongate metal strips surrounding the body above the upper expander surface, a second set of relatively thin, elongate metal strips surrounding the body below the lower expander surface, means including piston means for moving the first set of strips downwardly to cause their lower ends to slide over the upper expander surface and outwardly against the well bore, and for moving the second set of strips upwardly to cause their upper ends to slide over the lower expander surface and outwardly against the well bore, and means for initially supplying fluid pressure to the piston means for so moving the upper and lower sets of strips and then to the inside of the packing element so as to expand it into engagement with the well bore intermediate the ends of the first and second sets of reinforcing strips, said strips of each set being so arranged that the sides of their ends overlap when expanded, and at least certain of the strips having means on their outer sides for gripping the well bore when engaged therewith.

2. A bridge plug of the character defined in claim 1, wherein said piston means includes upper piston means for moving the upper set of slips and lower piston means for moving the lower set of strips.

3. A bridge plug of the character defined in claim 1, wherein fluid supplying means comprises first conduit means in the body connecting with the piston means, and second conduit means in the body connecting with the inside of the inflatable element, and the upper open end of the bore is connectable to the pipe string to enable pressure fluid to be supplied through the pipe string to each conduit means from a common source, and the second conduit means has normally closed valve means therein adapted to open when the ends of the strips have been expanded against the well bore.

4. A bridge plug of the character defined in claim 1, including means for holding the ends of said strips and the packing element against the well bore despite reduction in pressure of the pressure fluid.

5. A through the tubing bridge plug adapted to close off a well bore beneath the lower end of a well tubing, comprising a tubular body having a bore therein whose upper end is connectable to a pipe string for lowering therewith through the well tubing and whose lower end is closed, an elastomeric packing element surrounding the body, said body having downwardly and upwardly diverging expanding surfaces respectively above and below the packing element, first and second sets of relatively thin, elongate metal strips surrounding the body respectively above and below the upper and lower expander surfaces, means including a first pressure chamber in the body and a first piston means sealably slidable in the chamber and connected to the first set of strips to cause their lower ends to slide downwardly over the upper expander surface and outwardly against the well bore, means including a second chamber in the body and second piston means sealably slidable in the chamber and connected to the second set of strips to cause their upper ends to slide upwardly over the lower expander surface and outwardly against the well bore, said body having a port therein connecting its bore within the inside of the packing element and additional ports therein connecting its bore with the first and second pressure chambers, and a tube extending within the bore of the body in spaced relation thereto and having a closed lower end and upper and lower heads closing the bore, the upper and lower heads having ports therethrough to permit fluid pressure supplied through the pipe string to the upper end of the bore to pass through the upper head and downwardly between the tube and bore and through the tube beneath the lower head to connect with the additional ports connecting with the pressure chambers, and the lower head having a port therein connecting the lower end of the tube with the port connecting with the inside of the packing element, and valve means normally closing the bore through the upper end of the tube so that pressure fluid supplied through the pipe string is confined to flow first through the ports in the heads and into the pressure chambers in order to expand the ends of the strips, said valve means then opening in response to increased fluid pressure in order to inflate the packing element, said strips of each set being so arranged that the sides of their ends overlap when expanded, and at least certain of the strips having means on their outer sides for gripping the well bore when engaged therewith.

6. A bridge plug of the character defined in claim 5, including means connecting each of the first and second piston means to the body in their positions holding the strips contracted so as to maintain the ends of the strips in contracted positions, said connecting means being releasable and said piston means being movable in response to the supply of fluid to the piston means in order to expand the ends of the strips.

7. A bridge plug of the character defined in claim 5, wherein said valve means includes means for returning it to closed position upon reduction in the fluid pressure, and said body and each of the first and second piston means have means for automatically locking the piston means in the position to which they have been moved to expand the ends of the strips, whereby the bridge plug remains set despite reduction in fluid pressure in the pipe string.

* * * * *